United States Patent [19]

Terui et al.

[11] Patent Number: 4,660,884

[45] Date of Patent: Apr. 28, 1987

[54] RECLINING CHAIR

[75] Inventors: Mituru Terui; Masaaki Obata; Noriji Morooka, all of Kanagawa, Japan

[73] Assignee: Ikeda Bussan Co., Ltd., Ayase, Japan

[21] Appl. No.: 823,455

[22] Filed: Jan. 28, 1986

[30] Foreign Application Priority Data

Jan. 30, 1985 [JP] Japan ..... 60-11437[U]
Feb. 26, 1985 [JP] Japan ..... 60-26970[U]
Feb. 26, 1985 [JP] Japan ..... 60-26971[U]

[51] Int. Cl.[4] ..... A47C 1/02

[52] U.S. Cl. ..... 297/317; 297/257; 297/441

[58] Field of Search ..... 297/317, 320, 257, 441, 297/29, 39

[56] References Cited

U.S. PATENT DOCUMENTS 488,095 12/1892 Scott et al. ..... 297/441
2,512,353 6/1950 Magaldino et al. ..... 297/317
2,654,417 10/1953 Kirchofer ..... 297/29
2,812,801 11/1957 Heyman ..... 297/39
3,248,150 4/1966 Lilienfeld ..... 297/441
3,934,932 1/1976 Ekornes ..... 297/320
3,947,069 3/1976 Lusch ..... 297/317
4,045,081 8/1977 Ueno ..... 297/317

FOREIGN PATENT DOCUMENTS 854249 11/1952 Fed. Rep. of Germany ..... 297/257
53-45771 11/1978 Japan .

*Primary Examiner*—Francis K. Zugel
*Attorney, Agent, or Firm*—Schwartz, Jeffery, Schwaab, Mack, Blumenthal & Evans

[57] ABSTRACT

Herein disclosed is a reclining chair which comprises a seat cushion portion and a seatback portion which are pivotally connected so as to achieve simultaneous pivoting movements thereof. A generally U-shaped pipe frame is used for holding a seat cushion sheet. The portions of side sections of the U-shaped frame are projected in a direction away from the seat cushion sheet so that upon a person sitting on the seat cushion portion, the thigh portions of the seated person do not touch the side sections of the frame thereby providing him or her with comfortable sitting.

6 Claims, 11 Drawing Figures

RECLINING CHAIR

BACKGROUND OF THE INVENTION

1. Field of the Invention

The present invention relates in general to chairs, and more particularly to reclining chairs of a type wherein a seat cushion portion and a seatback portion are pivotally connected to achieve simultaneous pivotal movements thereof.

2. Description of the Prior Art

Hitherto, various kinds of reclining chairs of the type mentioned hereinabove have been proposed and put into practical use. However, some of them are complicated in construction and thus expensive, and due to their inherent constructions, some of them have failed to provide the person on the chair with comfortable sitting posture. This tendency is marked particularly in the chairs of a type wherein only sheets, such as canvas or the like, are used for supporting the body of a seated person. One of these chairs is disclosed in Japanese Utility Model Second Provisional Publication No. 53-45771.

SUMMARY OF THE INVENTION

It is therefore an essential object of the present invention to provide an improved reclining chair which is free of the above-mentioned drawback.

According to the present invention, there is provided a reclining chair which comprises a pair of supporting frames which are spaced from each other, cross members each extending between the supporting frames to assure tight assembly of the same, a first generally U-shaped frame including a base section and two side sections, the first frame being movably disposed in the supporting frames with the base section directed in one direction and the side sections directed in the opposite direction, a second generally U-shaped frame including a base section and two side sections, the second frame being pivotally connected at the side sections thereof to the supporting frames with the base section thereof downwardly projected into the space between the supporting frames, pivot means for providing a pivot connection between the leading end of each side section of the first frame and the downward projected portion of the second frame, a position adjuster mounted to each of the supporting frames to permit, under inoperative condition, axial movement of each side section of the first frame relative to the supporting frames and to secure, under operative condition, each side section of the first frame to the supporting frames, a first sheet spreaded between the respective base sections of the first and second frames, and a second sheet spreaded between the side sections of the second frame, wherein the middle portions of the side sections of the first frame are projected in a direction away from the first sheet.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Throughout the following description, the terms "forward" and "rearward" are to be understood as referring to "in the direction of the front of the chair" and "in the direction of the rear of the chair", and the terms "right" and "left" to be taken as "right" and "left" with respect to a person sitting on the chair.

Figure 1:
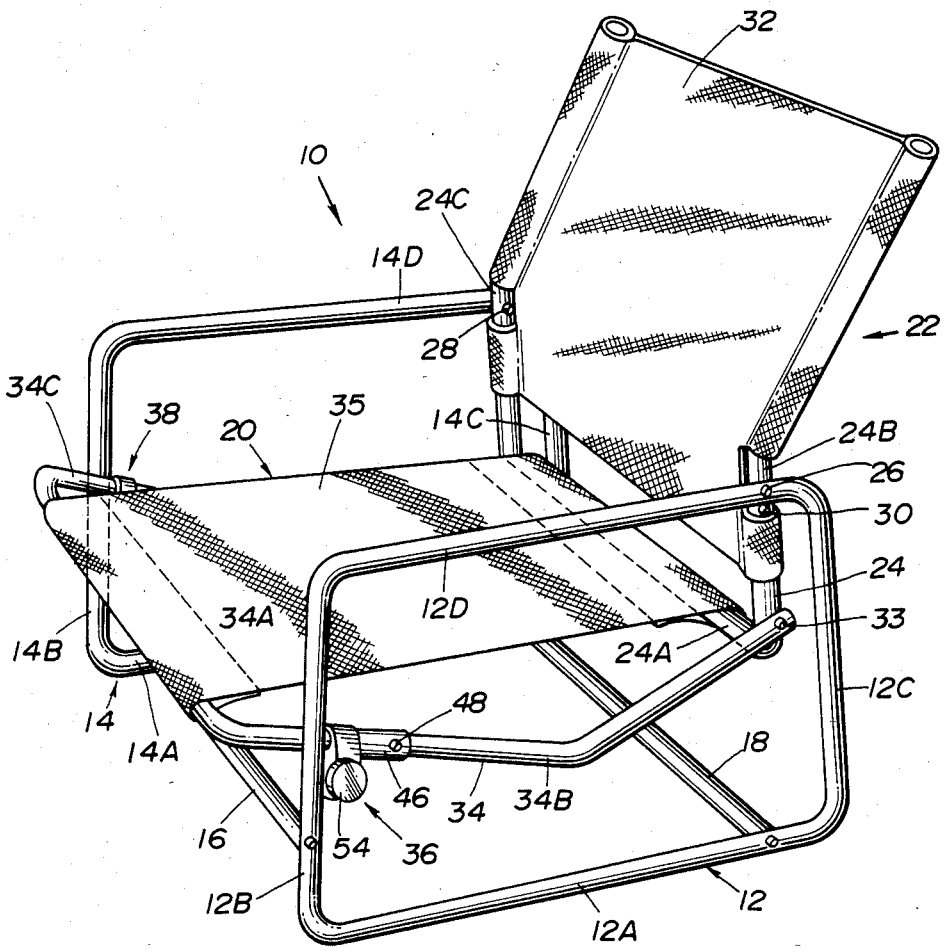
FIG. 1 is a perspective view of a chair of a first embodiment of the present invention.
Figure 2:
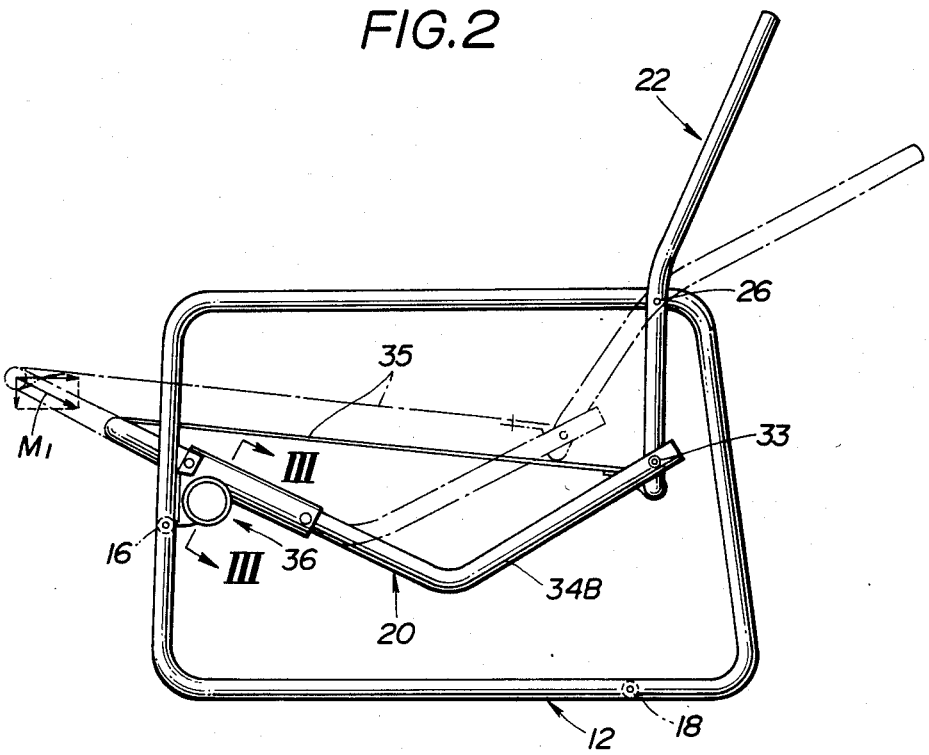
FIG. 2 is a side view of the chair of the first embodiment.
Figure 3:
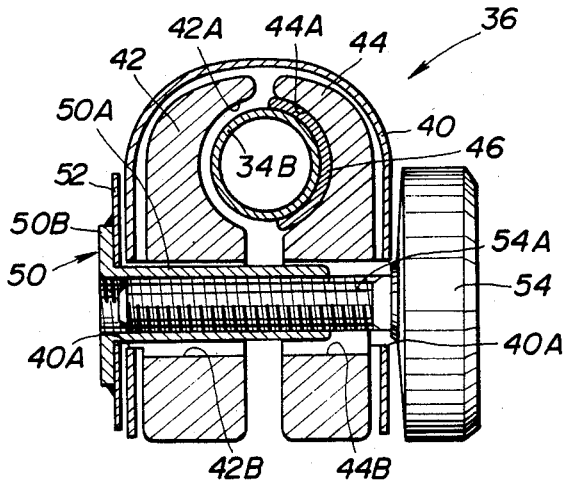
FIG. 3 is an enlarged sectional view of a position adjuster, which is taken along the line III—III of FIG. 2.

Referring to FIGS. 1 to 3, particularly FIG. 1, there is shown a first embodiment of the present invention, which is a single chair generally designated by numeral 10.

The chair 10 compreses two identical pipe frames or supporting frames 12 and 14 which are spaced parallelly from each other, each having a generally rectangular shape including a lower section 12A (or 14A), front and rear sections 12B and 12C (or 14B and 14C) and an upper section 12D (or 14D). The supporting frames 12 and 14 are combined by two cross pipes 16 and 18, one extending between lower portions of the front sections 12B and 14B of the frames 12 and 14, and the other extending between rear portions of the lower sections 12A and 14A of the same, as is understood from FIG. 1. The connection between each cross pipe 16 or 18 and each frame 12 or 14 is made by a conventional bolt-and-nut connection.

A seat cushion portion 20 and a seatback portion 22 are pivotally supported by the combined supporting frames 12 and 14 in the following manner.

For easy understanding, the description of the seatback portion 22 will be commenced prior to that of the seat cushion portion 20.

The seatback portion 22 comprises a generally U-shaped pipe frame or seatback frame 24 which thus includes a base section 24A and two side sections 24B and 24C. As is seen from the drawings, the side sections 24B and 24C of the pipe frame 24 are bent backward at their generally middle portions. The side sections 24B and 24C of the pipe frame 24 are received between the upper sections 12D and 14D, and pivotally connected at their bent portions to the rear portions of the upper sections 12D and 14D of the supporting frames 12 and 14. For this pivotal connection, externally threaded pivot bolts 26 and 28 are used, each passing through the side section 24B (or 24C) of the seatback frame 24 and the upper section 12D (or 14D) of the supporting frame 12 (or 14). Although not well shown in the drawings, each bolt 26 (or 28) is held in place by a corresponding nut secured thereto. It is thus to be noted that the U-shaped seatback frame 24 is swingable forward and rearward about the pivoted portions relative to the combined supporting frames 12 and 14. In order to restrict the forward and rearward swing of the seatback frame 24, stopper pins 30 (only one is shown in FIG. 1) are fixed to the side sections 24B and 24C of the frame 24 just below the pivot bolts 26 and 28, which are brought into contact with the corresponding upper sections 12D and 14D upon swing of the seatback frame 24. A rectangular sheet 32 constructed of for example "canvas" is spreaded between the side sections 24B and 24C of the seatback frame 24 with its lateral sides sewed to the side sections 24B and 24C. As shown, the pivoted portions of the side sections 24B and 24C of the seatback frame 24 are exposed, that is, not covered by the sheet 32 in order to assure the pivotal movement of the seatback portion 22 relative to the supporting frames 12 and 14.

The seat cushion portion 20 comprises a generally U-shaped pipe frame or seat cushion frame 34 which thus includes a base section 34A and two side sections 34B and 34C. As is seen from the drawings, the side sections 34B and 34C are bent downwardly at their middle portions for the purpose which will be described hereinafter. The leading or free ends of the side sections 34B and 34C are pivotally connected to the lower portions of the side sections 24B and 24C of the seatback frame 24 through respective pivot pins 33. A sheet 35 is spreaded between the base section 34A of the seat cushion frame 34 and the base section 24A of the seat back frame 24. The front portions of the side sections 34B and 34C of the seat cushion frame 34 are supported by the supporting frames 12 and 14 in the following manner.

For this supporting, a pair of position adjusters 36 and 38 are employed, each being arranged between the front portion of the side section 34B (or 34C) of the seat cushion frame 34 and the front section 12B (or 14B) of the supporting frame 12 (or 14). Since these two position adjusters 36 and 38 have substantially the same constructions, only one of them (that is the adjuster 36) will be described in the next for simplification of the description.

Referring to FIG. 3, there is shown the position adjuster 36 arranged between the front portion of the seat cushion frame 34 and the front section 12B of the supporting frame 12. The adjuster 36 comprises a generally U-shaped resilient bracket 40 and a pair of grippers 42 and 44 which are received in the bracket 40. The grippers 42 and 44 are respectively formed with semicircular recesses 42A and 44A at their inboard sides, so that upon mounting, the tubular side section 34B of the seat cushion frame 34 is axially slidably received in the recesses 42A and 44A. Designated by numeral 46 is a semicylindrical protecting plate which is interposed between the outboard gripper 44 and the side section 34B of the seat cushion frame 34 and secured to the side section 34B through bolts 48 (see FIG. 1). The U-shaped bracket 40 and the paired grippers 42 and 44 are formed with aligned bores 40A, 42B and 44B through which a tubular portion 50A of a supporter 50 passes. The tubular portion 50A is shorter than the axial length of the aligned bores 40A, 42B and 44B. The supporter 50 is securely connected through a reinforcing plate 52 to the front section 12B of the supporting frame 12. In the illustrated embodiment, the supporter 50 is welded to the reinforcing plate 52 at its circular base portion 50B. With this, it will be appreciated that the unit including the bracket 40 and the paired grippers 42 and 44 is pivotal about the tubular portion 50A of the supporter 50. The inside surface of the tubular portion 50A of the supporter 50 is threaded. An externally threaded bolt portion 54A of a handling knob 54 is received in and engaged with the internal thread of the tubular portion 50A of the supporter 50. Thus, it will be appreciated that when the handling knob 54 is turned sufficiently in a given direction, the U-shaped bracket 40 is resiliently deformed causing the grippers 42 and 44 to tightly catch the side section 34B of the seat cushion frame 34. With this, tight connection between the side section 34B of the frame 34 and the front section 12B of the supporting frame 12A is achieved. Similar to this, the other position adjuster 38 functions to achieve tight connection between the side section 34C of the cushion frame 34 and the front section 14B of the supporting frame 14.

When, with the chair 10 assuming the position as illustrated in FIG. 1, a person sits on the seat cushion portion 20, the sheet 35 is tightened with its central portion protruding downward. It is now to be noted that this sitting is carried out with his or her thigh portions kept away from the side sections 34B and 34C of the seat cushion frame 34 due to the downward bent constructions of the side sections 34B and 34C. Thus, the person can enjoy comfortable sitting.

Upon requirement of posture change of the chair 10, the handling knobs 54 of the position adjusters 36 and 38 are loosed, and the seatback portion 22 is manually swung forward or reaward to a desired position. With this movement of the seatback portion 22, the seat cushion portion 20 is swung about the position adjusters 36 and 38 permitting sliding of the side sections 34B and 34C of the seat cushion frame 34 in the adjusters 36 and 38. Then, the knobs 54 are fastened to tightly hold the newly set posture of the chair 10.

As will be seen from FIG. 2, the posture change of the chair 10 can be effected with a person sitting on the seat cushion portion 20 because of the pivotal movement of the adjusters 36 and 38 under unfastened condition of the handling knobs 54. That is, as is seen from FIG. 2, when a person sitting on the seat cushion portion 20 which assume the position illustrated by a phantom line inclines his or her upper half forward, the seat cushion portion 20 is swung down to the position illustrated by a solid line due to the resultant force $M_1$ applied to the seat cushion frame 34 in the direction parallel to the axis of each side section 34B or 34C of the frame 34. While, when the person sitting on the seat cushion portion 20 inclines his or her upper half rearward, the seat cushion portion 20 is swung up to the position illustrated by the phantom line against the resultant force $M_1$ applied to the seat cushion portion 20.

Figure 4:
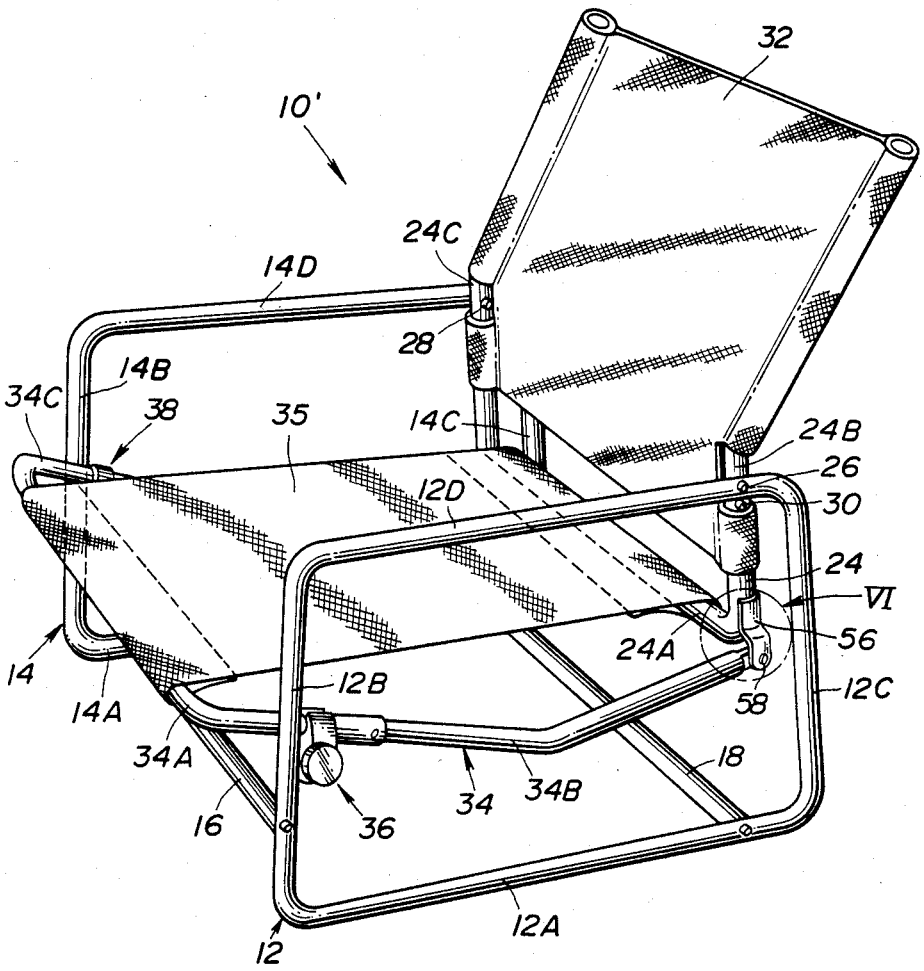
FIG. 4 is a perspective view of a chair of a second embodiment of the present invention.
Figure 5:
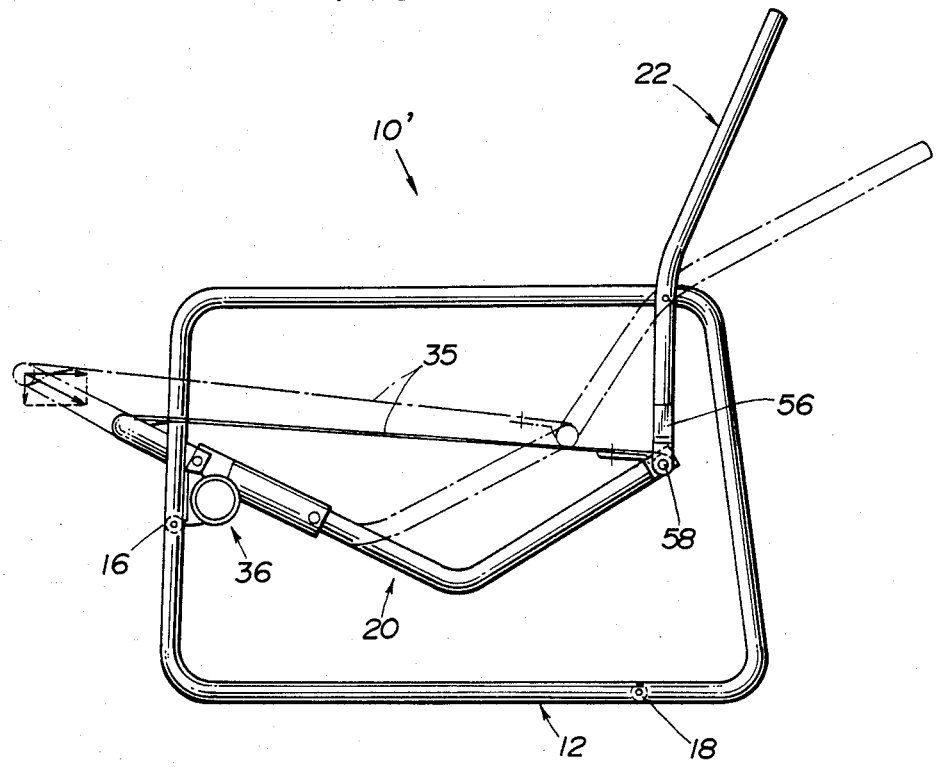
FIG. 5 is a side view of the chair of the second embodiment.

Referring to FIGS. 4 to 7, particularly FIG. 4, there is shown a second embodiment of the present invention.

Figure 6:
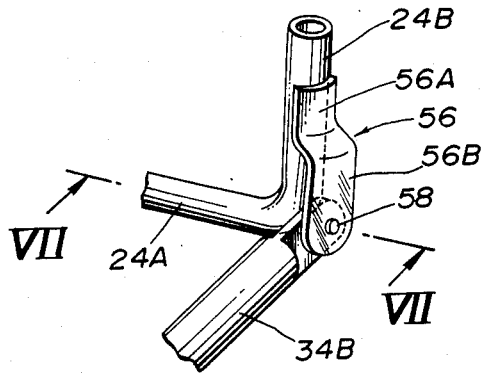
FIG. 6 is an enlarged perspective view of the portion enclosed by a circle "VI" of FIG. 4.
Figure 7:
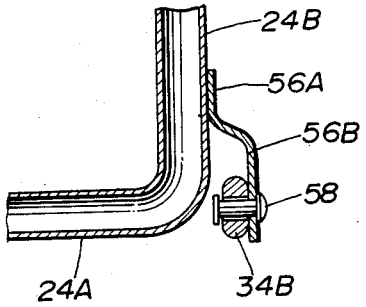
FIG. 7 is a sectional view taken along the line VII—VII of FIG. 6.

The chair 10' of the second embodiment comprises substantially the same parts as those of the afore-mentioned first embodiment except the pivoting means for pivotally connecting the seat cushion frame 34 to the seatback frame 24. That is, in the second embodiment, two brackets 56 (only one is shown in FIG. 4) are employed as elements of the pivoting means. As is best shown in FIGS. 6 and 7, each bracket 56 comprises a base section 56A secured to one side section 24B (or 24C) of the seatback frame 24, and an arm section 56B raised from the base section 56A. The leading or free end of the side section 34B (or 34C) of the seat cushion frame 34 is pivotally connected to the arm section 56B through a pivot pin 58. As is seen from FIG. 7, the pivot pin 58 is arranged to be coaxial with the base section 24A of the seatback frame 24.

Because of the arrangement as mentioned hereinabove, the length between the base section 34A of the seat cushion frame 34 and the base section 24A of the seatback frame 24 is kept constant regardless of postures which the chair 10'' assume. This induces constant tightening of the sheet 35 of the seat cushion portion thereby improving the external appearance of the chair 10'. Of course, the advantages of the first embodiment are also achieved in the second embodiment.

Figure 8:
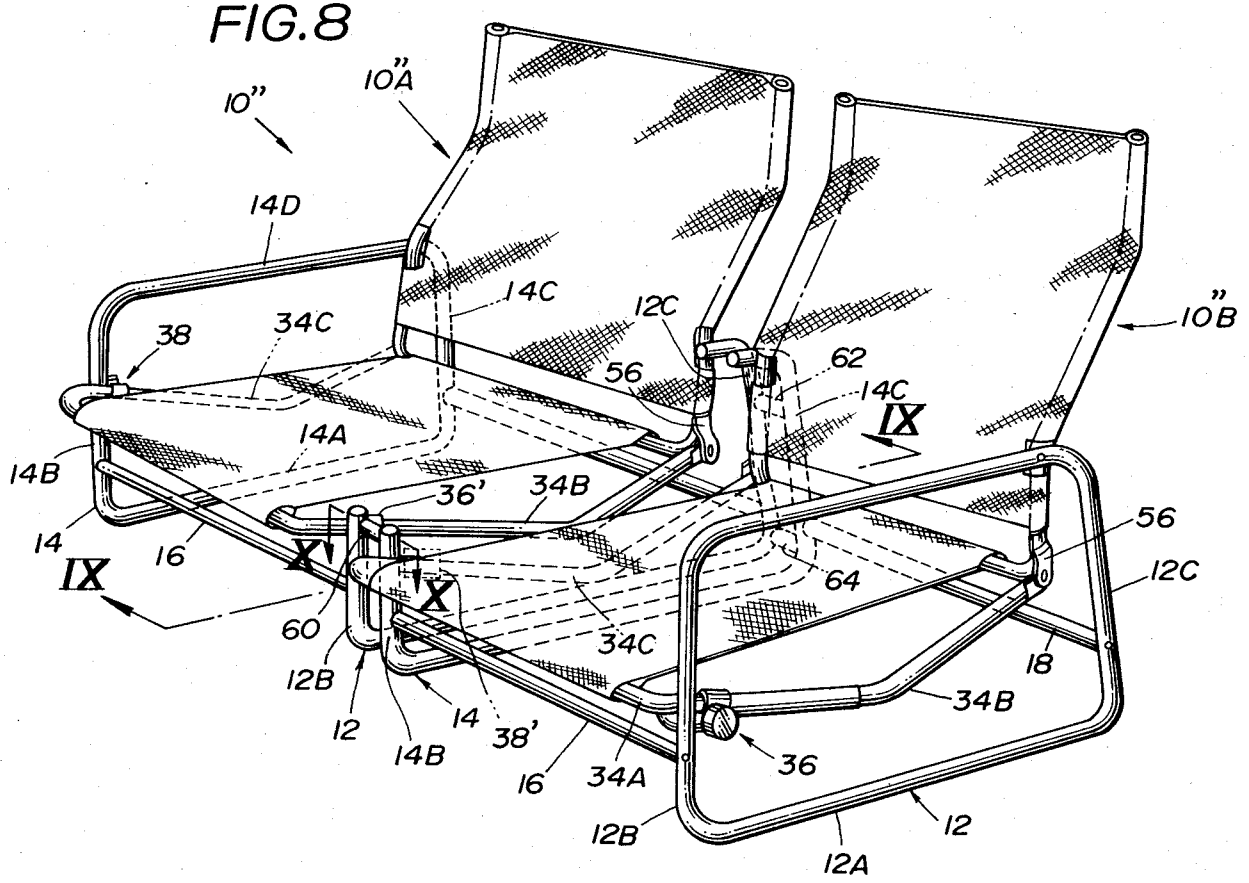
FIG. 8 is a perspective view of a twin chair of a third embodiment of the present invention.
Figure 9:
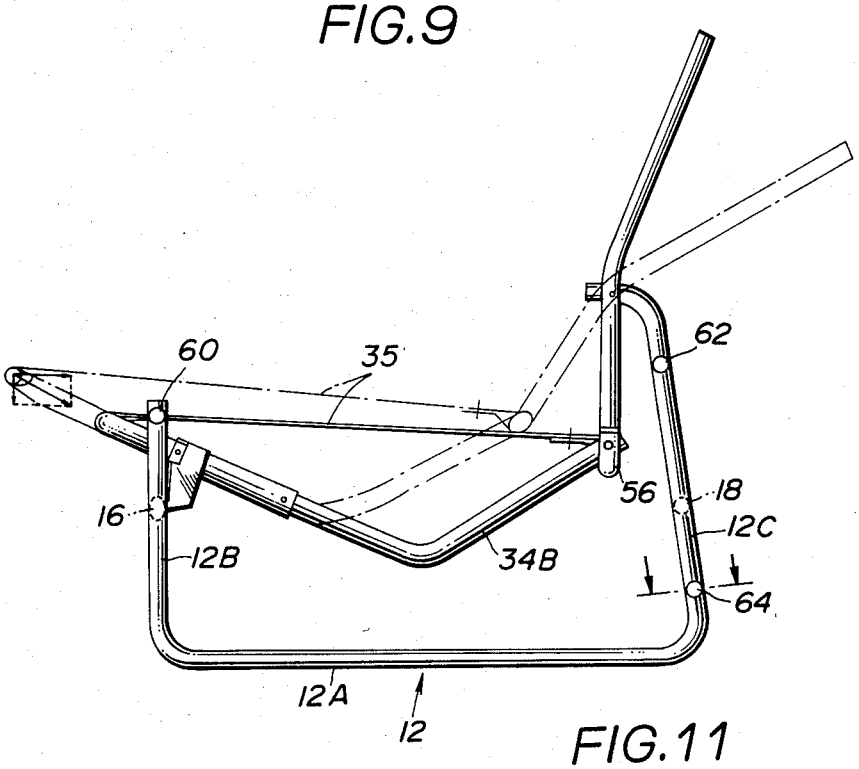
FIG. 9 is a view taken from the direction of the arrow IX—IX FIG. 8.
Figure 10:
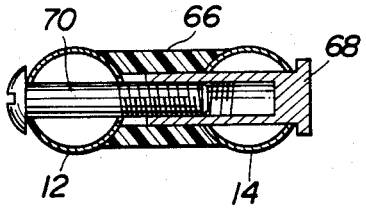
FIG. 10 is a sectional view taken along the line X—X of FIG. 8.

Referring to FIGS. 8 to 11, particularly FIG. 8, there is shown a twin chair 10'' of a third embodiment of the present invention. As will become apparent as the description proceeds, the twin chair 10'' is constructed to combine two similar chairs.

As is best seen from FIG. 4, the twin chair 10'' of the third embodiment comprises two, namely, right and left chairs 10''A and 10''B each being a slight modification of the chair 10' of the second embodiment. Thus, only the portions and arrangement of each chair 10''A or 10''B, which differ from those of the second embodiment, will be described in the following.

Figure 11:
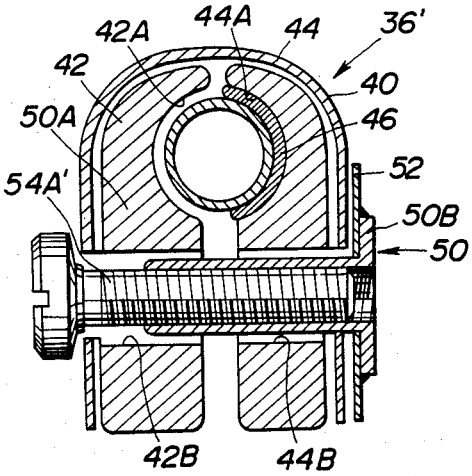
FIG. 11 is a sectional view of a pivotal supporter which is employed in the third embodiment.

In both chairs 10''A and 10''B, the cross pipe 16 extends between the front sections 12B and 14B of the supporting frames 12 and 14, and the other cross pipe 18 extends between the rear sections 12C and 14C of the supporting frames 12 and 14. In the right chair 10''A, the upper portion of the supporting frame 12 is cut off, while, in the left chair 10''B, the upper portion of the frame 145 is cut off. It is now to be noted that each of the chairs 10''A and 10''B has only one position adjuster 36 or 38 which is arranged at the outboard side of the associated chair 10''A or 10''B in such a manner as has been described hereinafore. Each chair has at its inboard side a pivotal supporter 36' or 38' the cross section of which is shown in FIG. 11. As is understood from this drawing, the pivotal supporter 36' (or 38') comprises substantially the same parts as those of the position adjuster 36 except the handling knob 54. That is, as a substitute for the handling knob, the supporter 36' uses a headed bolt 54A'. In practical use, the headed bolt 54A' is screwed to a position to permit not only sliding movement of the side section 34C relative to the pivotal supporter 36' but also pivotal movement of the supporter 36', relative to the front section 12B of the supporting frame 12.

As is seen from FIG. 8, the right and left chairs 10''A and 10''B are combined through three connectors 60, 62 and 64. The connector 60 is disposed between the respective front sections 12B and 14B of the inboard supporting frames 12 and 14 of the chairs 10''A and 10''B, while, the other connectors 62 and 64 are disposed between the respective rear sections 12C and 14C of the inboard supporting frames 12 and 14 of the chairs 10''A and 10''B. As is seen from FIG. 10, each of the connectors 60, 62 and 64 comprises a plastic hollow strut 66 which has semi-cylindrical recessed ends respectively mated with the inboard supporting frames 12 and 14. A headed internally threaded tubular shaft 68 is inserted through a hole of the pipe frame 14 into the plastic hollow strut 66. An externally threaded bolt 70 is inserted through the pipe frame 12 and engaged with the tubular shaft 68 in the strut 70. It is thus to be appreciated that a tight connection between the two frames 12 and 14 is achieved when the bolt 70 is tightly fastened.

In the twin chair 10'' as described hereinabove, the posture changes of the chairs 10''A and 10''B are independently achieved by manipulating the handling knobs 36 and 38. Of course, substantially the same advantages as those in the afore-mentioned first and second embodiments are also achieved from the third embodiment.

What is claimed is:

1. A reclining chair comprising:

a pair of supporting frames which are spaced from each other;

cross members each extending between the supporting frames to assure tight connection of the same;

a first generally U-shaped frame including a base section and two side sections, said first frame movably disposed between said supporting frames with said base section oriented to extend across front portions of said supporting frames and with said side sections oriented to extend from the front portions toward rear portions on the supporting frames;

a second generally U-shaped frame including a base section and two side sections, said second frame pivotally connected at the side sections thereof to the rear portions of said supporting frames with the base section thereof downwardly projected between said supporting frames;

pivot means providing a pivot connection between the rearwardly leading end of each side section of said first frame and the downwardly projected portion of said second frame;

a position adjuster mounted to each of the supporting frames to permit, under inoperative condition, axial movement of the side sections of the first frame relative to the supporting frames and to fix, under operative condition, the side sections of the first frame to the supporting frames;

a first sheet spread between the respective base sections of the first and second frames; and a second sheet spread between the side sections of the second frame;

wherein each of the side sections of said first frame has at a generally middle portion thereof a bent portion forming an obtuse angle and projecting downwardly in a direction away from said first sheet, and wherein the arrangement of said first and second frames is such that a distance between the base sections of said first and second frames is kept constant even when they change their angular positions relative to said supporting frames.

2. A reclining chair as claimed in claim 1, in which each of the supporting frames has a generally rectangular shape, so that it includes a lower section adapted to be directely set on the ground, front and rear sections upwardly extending from the front and rear portions of the lower section, and an upper section extending between the leading ends of the front and rear sections

3. A reclining chair as claimed in claim 2, in which said pivot means comprises pivot pins each being passed through the free end of each side section of the first frame and the downwardly projected portion of the second frame.

4. A reclining chair as claimed in claim 2, in which said pivot means comprises two brackets respectively secured to said side sections of the second frame at portions near the base section of the same, each bracket having a raised portion which is spaced from the base section of the second frame, and pivot shafts respectively connected to the raised portions of the brackets to pivotally connect the free ends of the side sections of the first frame to the same, each pivot shaft being arranged to coaxial with the base section of the first frame.

5. A twin chair comprising generally indentical two chairs each including:

a pair of supporting frames which are spaced from each other;

cross members each extending between the supporting frames to assure tight connection of the same;

a first generally U-shaped frame including a base section and two side sections, the first frame being movably disposed in the supporting frames with the base section directed in one direction and the side sections directed in the opposite direction;

a second generally U-shaped frame including a base section and two side sections, the second frame being pivotally connected at the side sections thereof to the supporting frames with the base section thereof donwardly projected into the space between said supporting frames;

pivot means for providing a pivot connection between the leading end of each side section of the first frame and the downward projected portion of the second frame;

a position adjuster mounted to each of the supporting frames to permit, under inoperative condition, axial movement of each side section of the first frame relative to the supporting frames and to secure, under operative conditon, each side section of the first frame to the supporting frames;

a first sheet spread between the respective base sections of the first and second frames; and a second sheet spread between the side sections of the second frame, wherein the middle portions of the side sections of the first frame form obtuse angles and are projected in a direction away from said first sheet, wherein the arrangement of said first and second frames is such that a distance between the base sections of said first and second frames is kept constant even when they change their angular positions relative to said supporting frames, and wherein said first and second chairs are arranged abreast and combined by connectors which are interposed between the inboard supporting frames of the first and second chairs.

6. A twin chair as claimed in claim 5, in which each of said connectors comprises a plastic hollow strut which is interposed between said inboard supporting frames, a headed internally threaded tubular shaft inserted through a hole of one of the inboard supporing frames into the plastic hollow strut, and an externally threaded bolt inserted through a hole of the other inboard supporting frame and engaged with the internally threaded tubular shaft in the hollow strut.

* * * * *